US006027375A

United States Patent [19]

Wu

[11] Patent Number: 6,027,375

[45] Date of Patent: Feb. 22, 2000

[54] ELECTRICAL CONNECTION DEVICE

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/326,451

[22] Filed: Jun. 4, 1999

[30] Foreign Application Priority Data

Sep. 11, 1998 [TW] Taiwan ..... 87215105

[51] Int. Cl.[7] ..... H01R 13/648

[52] U.S. Cl. ..... 439/607

[58] Field of Search ..... 439/607, 609, 439/541.5, 79

[56] References Cited

U.S. PATENT DOCUMENTS 5,637,015 6/1997 Tan et al. ..... 439/607
5,738,544 4/1998 Davis ..... 439/607
5,755,595 5/1998 Davis et al. ..... 439/609
5,797,770 8/1998 Davis et al. ..... 439/607

*Primary Examiner*—Gary F. Paumen
*Attorney, Agent, or Firm*—Wei Te Chung

[57] ABSTRACT

An electrical connector includes a unitary insulative housing having an upper half and a lower half respectively defining a first chamber and a second chamber therein. A plurality of first conductive pins are received in the first chamber and enclosed by a first shielding member to form a power connector for transmitting electrical power. A plurality of second conductive pins are received in the second chamber and enclosed by a second shielding member to form a signal connector for transmitting signals. The signal connector may be a USB (universal series bus) connector. Thus, the USB connector has an integral power connector for supplying electrical power to drive electronic devices connected thereto.

13 Claims, 5 Drawing Sheets

ELECTRICAL CONNECTION DEVICE

BACKGROUND OF THE INVENTION

1. Field of the Invention

The present invention generally relates to a receptacle electrical connector, and in particular to a USB (Universal Series Bus) connector having an integral power connector for supplying power to the USB connector to drive electronic devices connected thereto.

2. The Prior Art

A USB connector is capable of handling input/output signals of different types. Examples of USB connectors are disclosed in U.S. Pat. Nos. 5,017,156 and 5,326,281. The conventional USB connector is a low frequency data transmission connector requiring only a small power supply. If a large amount of power is required by a device connected to the USB connector, the connector often can not effectively drive the device. Thus, the device is usually powered by a separate power supply, which complicates the overall structure.

It is thus desirable to have an electrical connector structure that incorporates a power connector for receiving the necessary power to drive a device connected thereto.

SUMMARY OF THE INVENTION

Accordingly, an object of the present invention is to provide an electrical connection device which integrates a power connector with a USB connector for supplying power to the USB connector thereby maintaining proper signal transmission with electronic devices connected to the USB connector.

Another object of the present invention is to provide an electrical connector comprising a power supply for driving electronic devices connected to the connector.

To achieve the above objects, an electrical connection device in accordance with the present invention comprises a unitary insulative housing having an upper half and a lower half respectively defining a first chamber and a second chamber, therein. A plurality of first conductive pins are received in the first chamber and enclosed by a first shielding member to form a power connector for transmitting electrical power. A plurality of second conductive pins are received in the second chamber and enclosed by a second shielding member to form a signal connector for transmitting signals. The signal connector may be a USB (Universal Series Bus) connector. Thus, the USB connector has an integral power connector for supplying electrical power to drive associated electronic devices connected thereto.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
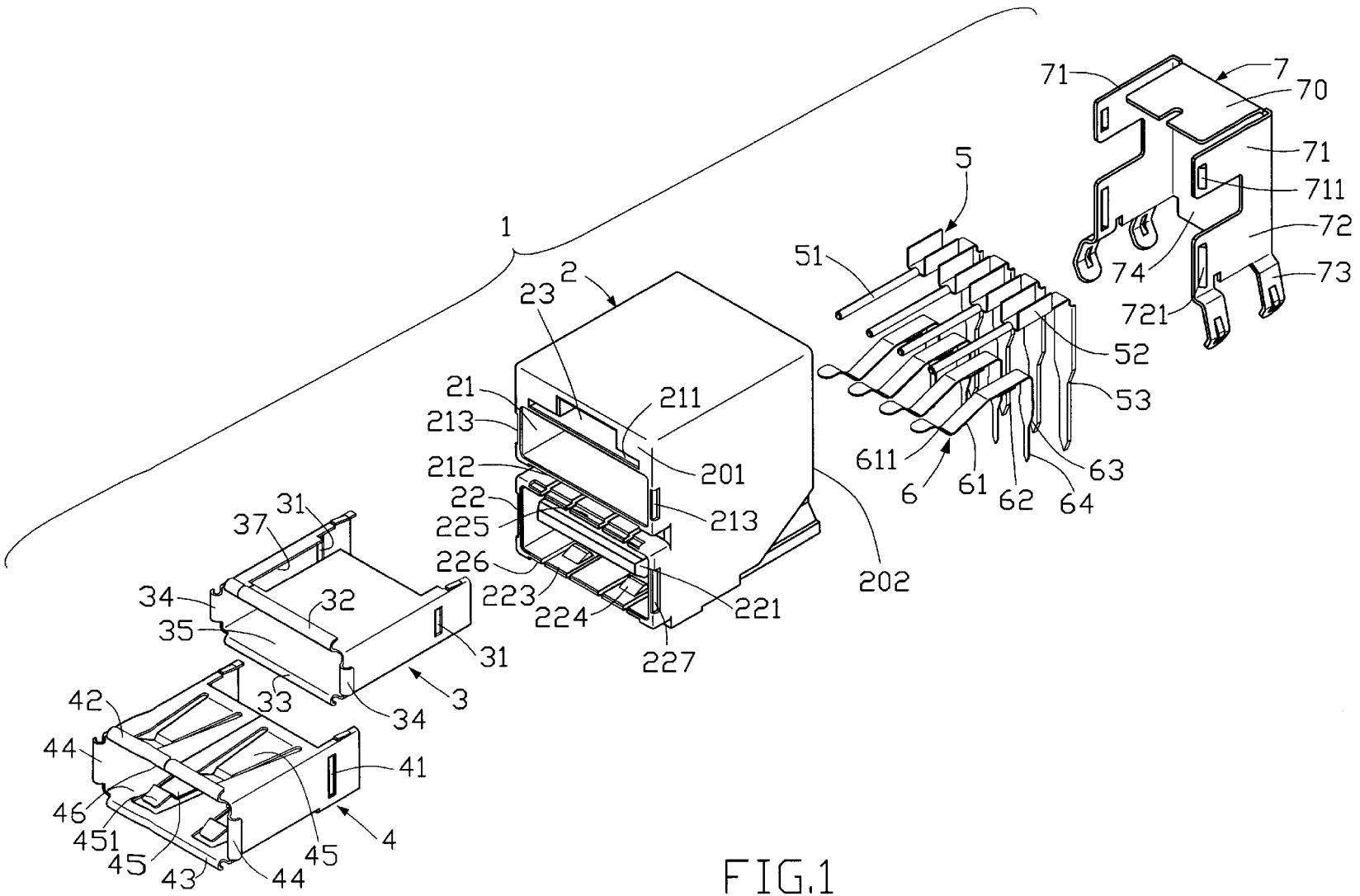
FIG. 1 is an exploded view of an electrical connection device in accordance with the present invention.
Figure 2:
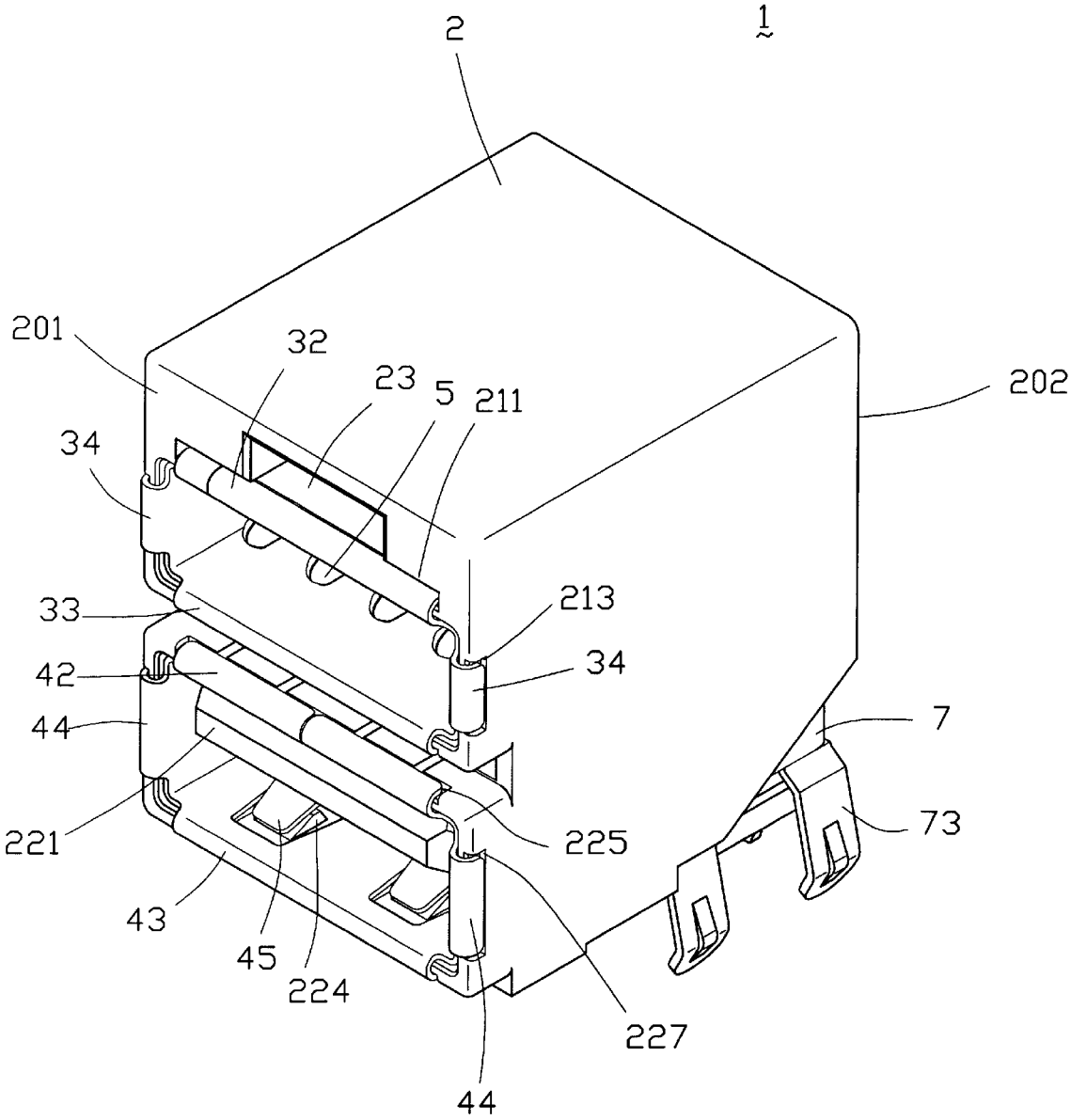
FIG. 2 is an assembled view of FIG. 1.

Referring to the drawings and in particular to FIGS. 1 and 2, wherein a receptacle electrical connection device in accordance with the present invention, generally designated by reference numeral 1, is shown, the electrical connection device 1 comprises a signal connector and a power connector integrated as a unitary device.

The unitary electrical connection device 1 of the present invention comprises an insulative housing 2 that may be regarded as a combination of an insulator of the signal connector and an insulator of the power connector. Thus, hereinafter, the housing 2 is described to have an upper half and a lower half (both not labeled) respectively associated with the signal connector and the power connector. The upper half and the lower half are integrally formed as a unitary member.

Figure 3:
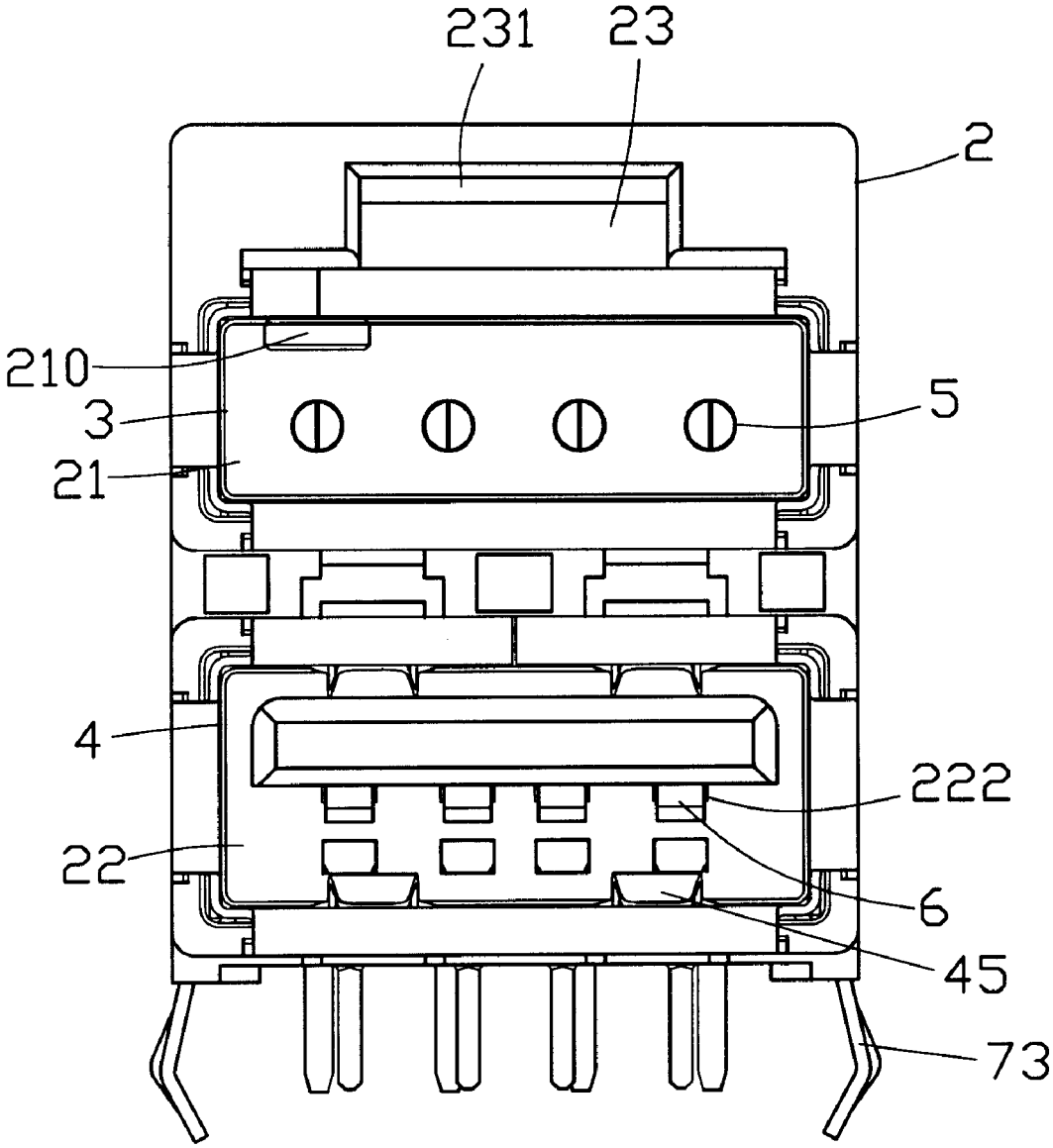
FIG. 3 is a front view of FIG. 2.
Figure 4:
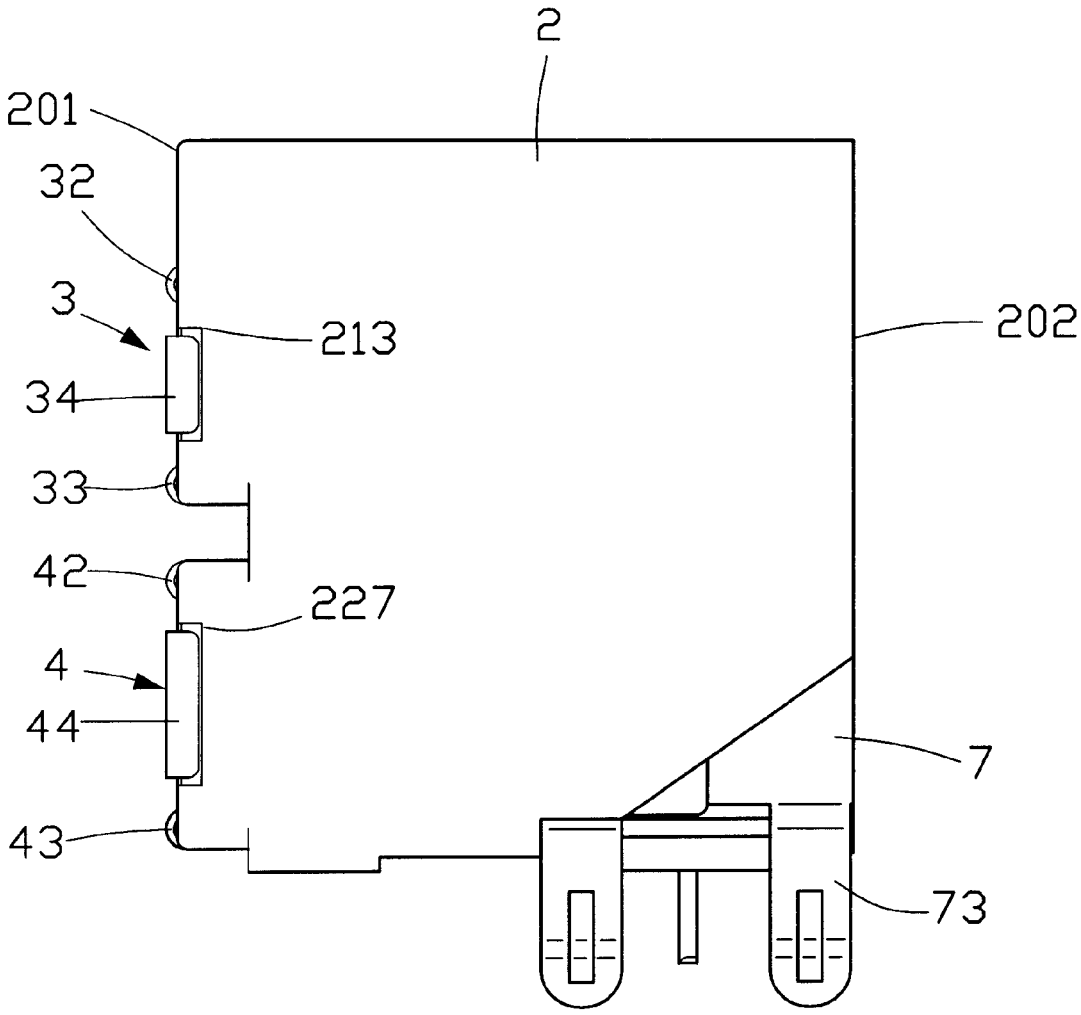
FIG. 4 is a side, elevational view of FIG. 2.
Figure 5:
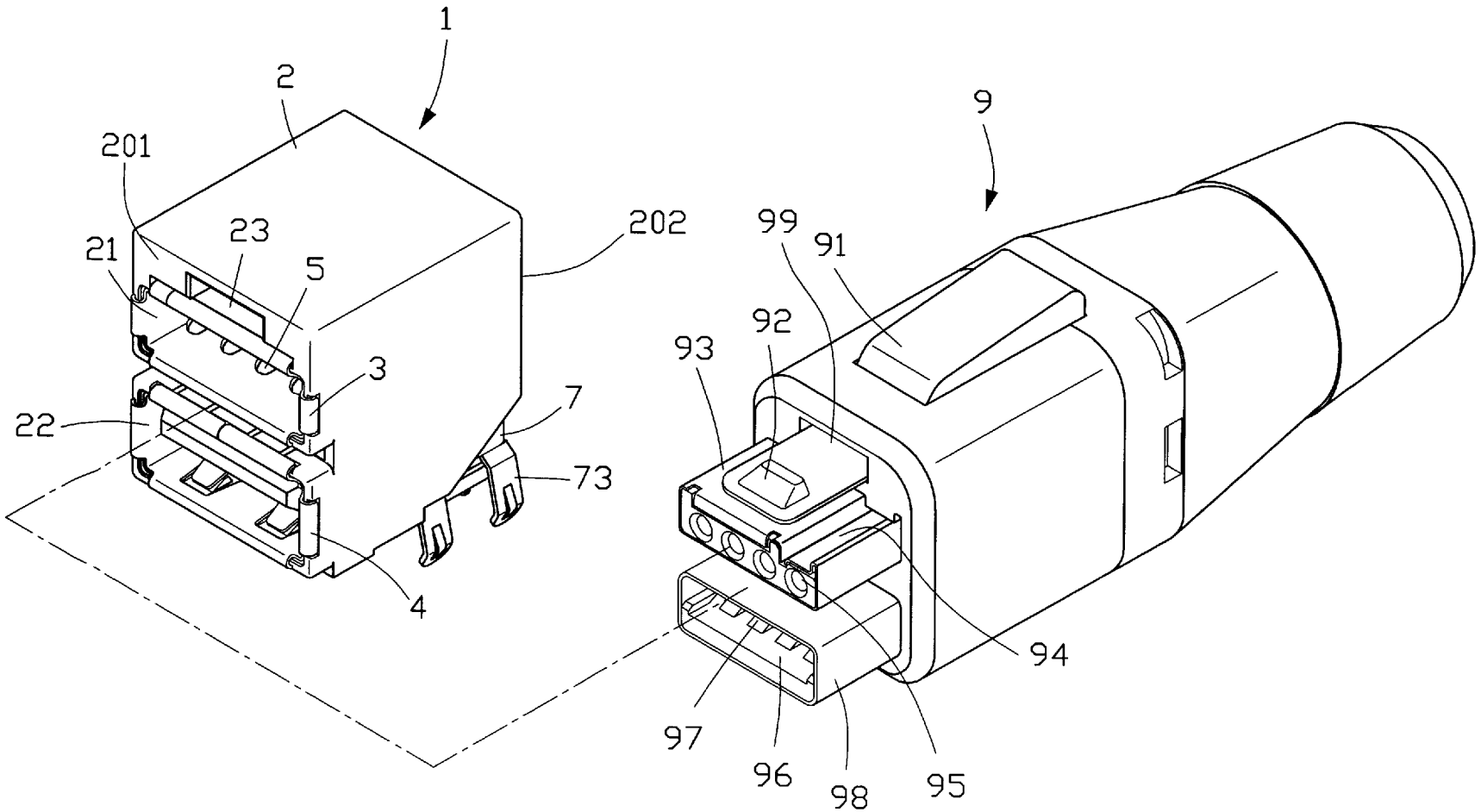
FIG. 5 is a perspective view of the present electrical connection device and a mating connection device.

The housing 2 has a front face 201 and a rear face 202 opposite the front face 201. The upper half and the lower half of the housing 2 respectively define a first chamber 21 and a second chamber 22 between the front face 201 and the rear face 202. The first and second chambers 21, 22 respectively receive a plurality of first and second conductive pins 5, 6 therein. An upper engaging slot 211, a bottom engaging slot 212 and side engaging slots 213 are defined in the front face 201 of the upper half surrounding the first chamber 21. A first front shielding member 3 having a bottom wall and two side walls is received in the first chamber 21 from the front face 201. The first front shielding member 3 has a front opening 35 defined between an upper edge, a bottom edge and two side edges, and is dimensioned to receive a corresponding portion of a mating connection device 9 (FIG. 5). Each of the four edges of the front opening 35 of the first front shielding member 3 respectively form an outward flange 32, 33, 34 for being received in and engaging with the corresponding engaging slots 211, 212, 213 of the upper half of the housing 2 (FIGS. 2 and 4). The first chamber 21 also comprises a positioning block 210 (FIG. 3) formed on an upper inside face thereof for preventing incorrect mating of the connection device 1 with the mating connector 9, which will be described in further detail hereunder. Because the front shielding member 3 is inserted into the first chamber 21, a slot 37 (FIG. 1) is defined in the shielding member 3 for allowing the positioning block 210 to extend therethrough.

An upper engaging slot 225, a bottom engaging slot 226 and side engaging slots 227 are defined in the front face 201 of the lower half. A second front shielding member 4 having a top wall, a bottom wall and two side walls is received in the second chamber 22. The second front shielding member 4 has a front opening 46 defined between an upper edge, a bottom edge and two side edges, and dimensioned to receive a corresponding portion of the mating connection device 9 (FIG. 5). Each of the four edges of the front opening 46 of the second front shielding member 4 respectively form an outward flange 42, 43, 44 for being received in and engaging with the corresponding engaging slots 225, 226, 227 of the lower half of the housing 2 (FIGS. 2 and 4)

Preferably, the second chamber 22 of the housing 2 comprises cantilevered arms 223 formed on upper and lower inside faces thereof. Each cantilevered arm 223 has an inward projection 224. Corresponding to the cantilevered arms 223, the second front shielding member 4 comprises a plurality of resilient arms 45, each having a bent free end 451 engageable with the projection 224 of the corresponding cantilevered arm 223.

A rear shielding member 7 comprises a rear wall 74 from which two side walls extend. Each side wall comprises an upper section 71 and a lower section 72 separated from each other. The upper and lower sections 71, 72 are respectively received in the first and second chambers 21, 22. The rear shielding member 7 also comprises a top wall 70 which is received in the first chamber 21 to substantially cover an open top face of the first front shielding member 3. Each upper and lower section 71, 72 of the side walls of the rear shielding member 7 comprises a protrusion 711, 721 which engages with a corresponding notch 31, 41 defined in the side walls of the first and second front shielding members 3, 4. Thus, the rear shielding member 7 is secured to the housing 2 and electrical connection is established between the front shielding members 3, 4 and the rear shielding member 7.

The rear shielding member 7 is provided with a plurality of grounding tabs 73 which downwardly extend beyond the housing 2 (FIG. 2) and are adapted to be electrically connected to a printed circuit board (not shown) for grounding and noise suppression purposes.

The first conductive pins 5 each comprise a mating section 51 for electrically engaging a corresponding receptacle terminal 95 (FIG. 5) of the mating connection device 9 and a tail section 53 for electrically engaging a corresponding electrical contact of an external device for supplying electrical power thereto. A connection section 52 comprising a bent portion and connecting the tail section 53 to the mating section 51 is interferentially fit into and thus retained in a corresponding channel (not shown) defined in the first chamber 21.

The second chamber 22 comprises a tongue 221 formed therein for being received in a slot 96 defined in the mating connection device 9. The tongue 221 of the second chamber 22 forms a plurality of grooves 222 on a bottom surface thereof.

The second conductive pins 6 each comprise a mating section 61 comprising a resilient arm having a projection 611 for electrically engaging with a conductive member 97 formed in the slot 96 of the mating connection device 9 and a tail section 64 to be soldered to the circuit board. The tail section 64 is connected to the mating section 61 by means of a connection section comprising a first segment 62 and a second segment 63 respectively extending from the mating section 61 and the soldering section 64. The first segment 62 is dimensioned to be snugly received in the corresponding grove 222 of the tongue 221, while the second segment 63 is retained by the rear face 202 of the housing 2.

Referring to FIG. 5, the mating connection device 9 comprises a power connector portion comprising a projection 93 receivable in the first chamber 21. The projection 93 includes the receptacle terminals 95 that engage with the corresponding mating sections 51 of the first conductive pins 5. The projection 93 defines a positioning groove 94 corresponding to and receiving the positioning block 210 of the first chamber 21.

The mating connection device 9 also comprises a signal connector portion comprising a shielding enclosure 98 receivable in the second chamber 22 and engaged by the bent free ends 451 of the resilient arms 45 of the second front shielding member 4 thereby forming electrical connection therebetween for grounding purposes. The enclosure 98 defines the slot 96 in which the conductive members 97 are formed for electrically engaging the projections 611 of the mating sections 61 of the corresponding second pins 6.

Preferably, the mating connection device 9 is provided with releasable securing means comprising an extended plate 99 received in a slot 23 defined in the front face 201 of the housing 2. The plate 99 forms a tab 92 engageable with an inner barb 231 (FIG. 3) formed inside the slot 23 for securing the mating connection device 9 to the housing 2 of the connection device 1. A release button 91 is provided on the mating connection device 9 for releasing the engagement between the tab 92 of the mating connection device 9 and the inner barb 231 of the electrical connection device 1 thereby detaching the mating connection device 9 from the connection device 1.

Although the present invention has been described with respect to a preferred embodiment, it is obvious that equivalent alterations and modifications will occur to those skilled in the art upon reading and understanding the above detailed description. The present invention includes all such equivalent alterations and modifications and is limited only by the scope of the appended claims.

What is claimed is:

1. An electrical connection device adapted to mate a mating connection device, comprising:

an insulative housing having an upper half and a lower half respectively defining a first chamber and a second chamber therein between a front face and a rear face of the housing;

a first discrete shielding member received in the first chamber from the front side of the housing and fixed to the upper half of the housing, the first discrete shielding member having a front opening;

a second shielding member received in the second chamber from the front side of the housing and fixed to the lower half of the housing, the second shielding member having a front opening;

first conductive pins having mating sections arranged in the first chamber and enclosed by the first shielding member to form a first connector for engaging corresponding first connecting means of the mating connection device, the first connecting means of the mating connection device being received through the front opening of the first shielding member; and second conductive pins having mating sections arranged in the second chamber and enclosed by the second shielding member to form a second connector for engaging corresponding second connecting means of the mating connection device, the second connecting means of the mating connection device being received through the front opening of the second shielding member.

2. The electrical connection device as claimed in claim 1, wherein the first connector of the electrical connection device serves as a power connector for connecting with a power supply and the second connector serves as a signal connector for connecting with a signal source.

3. The electrical connection device as claimed in claim 1 further comprising a rear shielding member having two side walls each comprising an upper section for being fit into the first chamber and a lower section for being fit into the second chamber.

4. The electrical connection device as claimed in claim 3, wherein each of the upper and lower sections of the rear shielding member forms a protrusion thereon, the protrusion being engageable with a corresponding opening defined in the first and second shielding members thereby securing the rear shielding member to the front shielding members and establishing electrical connection therebetween.

5. The electrical connection device as claimed in claim 1, wherein the front opening of the first shielding member is defined between four edges, each edge forming an outward flange received in and engaging with a corresponding slot defined in the upper half of the housing.

6. The electrical connection device as claimed in claim 1, wherein the front opening of the second shielding member is defined between four edges, each edge forming an outward flange received in and engaging with a corresponding slot defined in the lower half of the housing.

7. The electrical connection device as claimed in claim 3, wherein the rear shielding member comprises grounding tabs adapted to be electrically connected to external grounding means.

8. The electrical connection device as claimed in claim 1, wherein each first pin further comprises a tail section connected to the mating section by means of a connection section securely retained in the housing, the tail section extending beyond the housing and adapted to electrically engage power contacts of a circuit board.

9. The electrical connection device as claimed in claim 1, wherein the second connector comprises a tongue formed in the second chamber, the tongue forming grooves thereon for receiving the mating sections of the second pins.

10. The electrical connection device as claimed in claim 9, wherein each second pin further comprises a tail section connected to the mating section by means of a connection section securely retained in the housing, the tail section extending beyond the housing and adapted to electrically engage an external device.

11. The electrical connection device as claimed in claim 1, wherein the first chamber comprises a positioning block formed on an inside surface thereof, and wherein the first connecting means of the mating connection device comprises a projection receivable in the first chamber, the projection defining a groove for receiving the positioning block.

12. The electrical connection device as claimed in claim 1, wherein the housing defines a slot in which a barb is formed, and wherein the mating connection device comprises an extended portion receivable in the slot, the extended portion comprising a tab engageable with the barb of the slot for retaining the mating connection device and the electrical connection device together.

13. The electrical connection device as claimed in claim 1, wherein the second connector comprises resilient arms formed on the second shielding member and located in the second chamber, and wherein the second connecting means of the mating connection device comprises a conductive enclosure receivable in the second chamber and electrically engaged by the resilient arms of the second shielding member.

* * * * *